US010443599B2

(12) United States Patent
Graulich et al.

(10) Patent No.: US 10,443,599 B2
(45) Date of Patent: Oct. 15, 2019

(54) MECHANICAL VACUUM PUMP FOR A MOTOR VEHICLE

(71) Applicant: PIERBURG PUMP TECHNOLOGY GMBH, Neuss (DE)

(72) Inventors: Alexander Graulich, Stolberg (DE); Karl-Heinz Kirberg, Juechen (DE); Klaus Vosmerbaeumer, Essen (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 200 days.

(21) Appl. No.: 15/534,004

(22) PCT Filed: Dec. 9, 2015

(86) PCT No.: PCT/EP2015/079064
§ 371 (c)(1),
(2) Date: Jun. 8, 2017

(87) PCT Pub. No.: WO2016/091922
PCT Pub. Date: Jun. 16, 2016

(65) Prior Publication Data

US 2018/0335035 A1 Nov. 22, 2018

(30) Foreign Application Priority Data

Dec. 12, 2014 (EP) ..... 14197706

(51) Int. Cl.
*F04C 29/02* (2006.01)
*F04C 25/02* (2006.01)
(Continued)

(52) U.S. Cl.
CPC ..... *F04C 29/025* (2013.01); *F04C 18/344* (2013.01); *F04C 25/02* (2013.01);
(Continued)

(58) Field of Classification Search
CPC ..... F04C 29/02; F04C 18/322; F04C 18/344; F04C 25/02; F04C 29/005; F04C 29/0085; F04C 29/023; F04C 29/071
(Continued)

(56) References Cited

U.S. PATENT DOCUMENTS 2,148,070 A 2/1939 Gregg
2002/0150489 A1* 10/2002 Kim ..... F01C 21/08 418/13

(Continued)

FOREIGN PATENT DOCUMENTS

CN 102365461 A 2/2012
EP 1 108 892 A2 6/2001

(Continued)

OTHER PUBLICATIONS

ESPACENET English translation of WO2006122516 Feb. 25, 2019.*

*Primary Examiner* — Deming Wan
(74) *Attorney, Agent, or Firm* — Norman B. Thot

(57) ABSTRACT

A mechanical vacuum pump for a motor vehicle includes a stationary pump housing, a pump rotor rotatably mounted in the pump housing, a plug-coupling element connected for a conjoint rotation with the pump rotor, and a lubricant supply for lubricating the plug-coupling element. The lubricant supply has a lubricant supply channel arranged in the pump housing and a lubricant transport channel arranged in the pump rotor. The lubricant supply channel is arranged so that a lubricant is pumped from a lubricant inlet to a transfer opening. The lubricant transport channel is arranged so that the lubricant is pumped from an acceptance opening to a lubricant outlet opening. The transfer opening and the acceptance opening are temporarily in a fluid communication with each other at least once when the pump rotor rotates. The
(Continued)

lubricant outlet opening is arranged with an eccentricity in an end wall of the pump rotor.

5 Claims, 5 Drawing Sheets

(51) Int. Cl.
*F04C 29/00* (2006.01)
*F04C 18/344* (2006.01)
*F02B 67/04* (2006.01)

(52) U.S. Cl.
CPC ..... *F04C 29/005* (2013.01); *F04C 29/0071* (2013.01); *F04C 29/02* (2013.01); *F02B 67/04* (2013.01)

(58) Field of Classification Search
USPC ..... 418/88, 84, 206.1–206.9
See application file for complete search history.

(56) References Cited

U.S. PATENT DOCUMENTS

| | | | | |
|---|---|---|---|---|
| 2002/0192097 | A1* | 12/2002 | Otto | F01C 21/08 418/152 |
| 2012/0076682 | A1 | 3/2012 | Sakakibara et al. | |
| 2014/0034960 | A1 | 11/2014 | Heaps et al. | |
| 2015/0240816 | A1 | 8/2015 | Wallenfels | |

FOREIGN PATENT DOCUMENTS

| | | | | |
|---|---|---|---|---|
| EP | 2 559 903 | A1 | 2/2013 | |
| JP | 58-133495 | A | 8/1983 | |
| JP | 2004-92504 | A | 3/2004 | |
| WO | WO-2006122516 | A1 * | 11/2006 | F04C 18/3442 |
| WO | WO 2009/046810 | A1 | 4/2009 | |
| WO | WO 2014/063681 | A1 | 5/2014 | |

* cited by examiner

MECHANICAL VACUUM PUMP FOR A MOTOR VEHICLE

CROSS REFERENCE TO PRIOR APPLICATIONS

This application is a U.S. National Phase application under 35 U.S.C. § 371 of International Application No. PCT/EP2015/079064, filed on Dec. 9, 2015 and which claims benefit to European Patent Application No. 14197706.6, filed on Dec. 12, 2014. The International Application was published in German on Jun. 16, 2016 as WO 2016/091922 A1 under PCT Article 21(2).

FIELD

The present invention relates to a mechanical vacuum pump for motor vehicles which is designed to be coupled for conjoint rotation with a corresponding plug-coupling element of an internal combustion engine of a motor vehicle via a pump-side plug-coupling element, and which is lubricated with lubricant supplied from the side of the pump.

BACKGROUND

A plug-coupling arrangement is generally used to couple mechanical vacuum pumps with the crankshaft or the drive shaft of the internal combustion engine for conjoint rotation. The plug-coupling arrangement is formed by plug-coupling elements which are designed to be complementary to each other, having one or a plurality of claws engaging into corresponding recesses of the respective other plug-coupling element. For a facilitation of assembly and for a mechanical decoupling of the pump rotor from the corresponding shaft, the plug-coupling arrangement has radial and axial play so that friction occurs in the area of the plug-coupling arrangement that makes lubrication necessary.

A mechanical vacuum pump for motor vehicles is described in WO 2014/063681 A1 which comprises a lubricant supply in which the liquid lubricant is transferred through a stationary lubricant supply channel in the pump housing into a rotating lubricant transport channel in the pump rotor, through which the lubricant is directed axially into the center of the plug-coupling arrangement to between the two plug-coupling elements. This structure is comparatively complex and the retaining bolt which is exposed to great mechanical stress is mechanically weakened by the axial bore. The lubricant must also be pumped into the axial center of the rotating pump rotor so that, in particular at high rotational speeds, substantial centrifugal forces must be overcome that act on the lubricant.

SUMMARY

An aspect of the present invention is to provide a mechanical vacuum pump for a motor vehicle which has a lubricant supply having a simple construction.

In an embodiment, the present invention provides a mechanical vacuum pump for a motor vehicle which includes a stationary pump housing, a pump rotor comprising an end wall, a separate pump-side plug-coupling element which is connected for a conjoint rotation with the pump rotor, and a lubricant supply for lubricating the separate pump-side plug-coupling element. The pump rotor is rotatably mounted in the pump housing. The lubricant supply comprises a lubricant supply channel arranged in the pump housing and a lubricant transport channel arranged in the pump rotor. The lubricant supply channel comprises a lubricant inlet and a transfer opening. The lubricant supply channel is arranged so that a lubricant can be pumped from the lubricant inlet in a direction of the separate pump-side plug-coupling element to the transfer opening. The lubricant transport channel comprises an acceptance opening and a lubricant outlet opening. The lubricant transport channel is arranged so that the lubricant can be pumped from the acceptance opening to the lubricant outlet opening. The transfer opening and the acceptance opening are arranged so that they are temporarily in a fluid communication with each other at least once during a rotation of the pump rotor. The lubricant outlet opening is arranged with an eccentricity in the end wall of the pump rotor.

BRIEF DESCRIPTION OF THE DRAWINGS

The present invention is described in greater detail below on the basis of embodiments and of the drawings in which.

DETAILED DESCRIPTION

Figure 1:
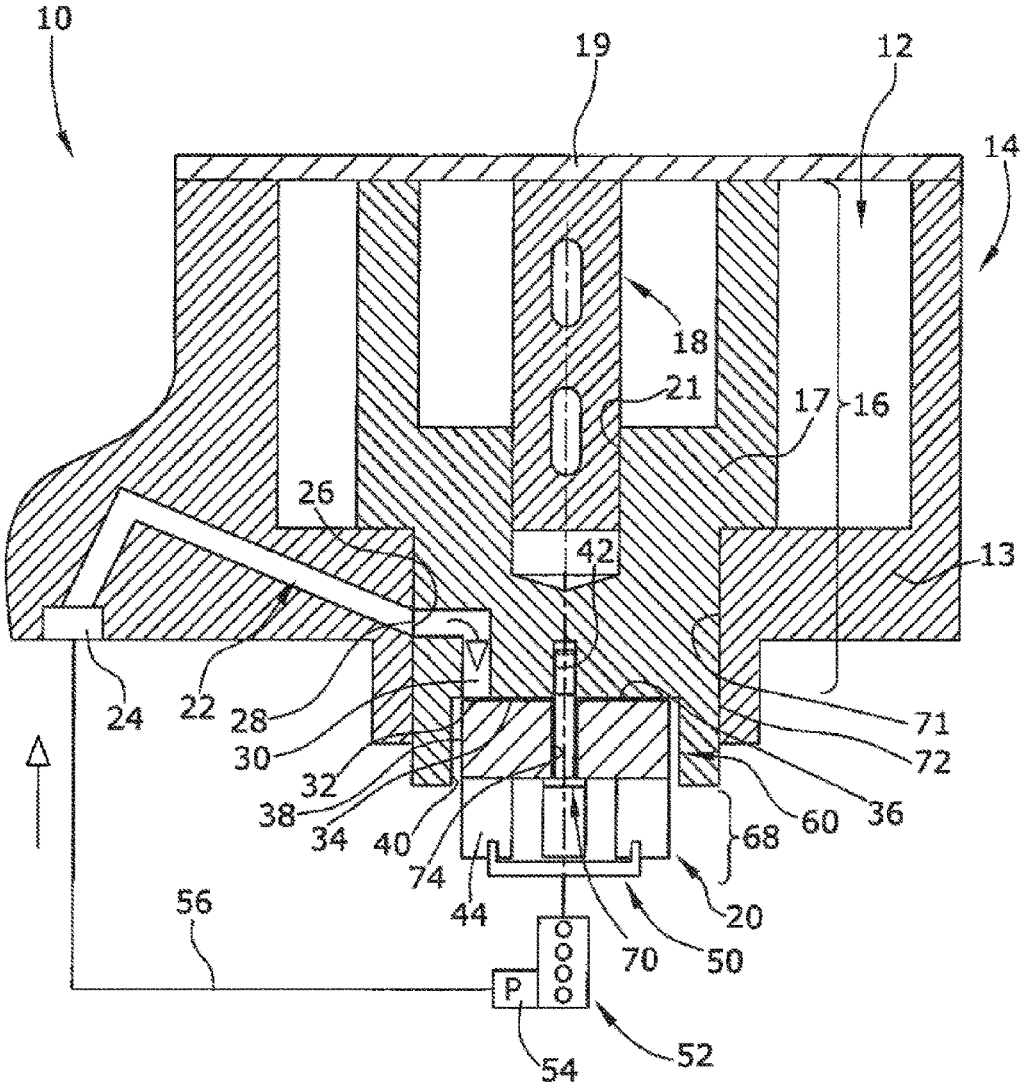
FIG. 1 shows a longitudinal section through a mechanical vacuum pump for a motor vehicle according to the present invention.

The mechanical vacuum pump for a motor vehicle according to the present invention comprises a pump rotor which is rotatably supported in a stationary pump housing and a separate rotor-side plug-coupling element. The pump-side plug-coupling element is connected with the pump rotor for rotation therewith, but with axial and radial play. A stationary lubricant supply channel is arranged in the pump housing through which the lubricant is pumped from a lubricant inlet at the pump housing in the direction of the plug-coupling element to a transfer opening of the pump housing.

A lubricant transport channel is provided in the pump rotor, the lubricant being guided from an acceptance opening through the transport channel to a lubricant outlet opening. The housing-side transfer opening and the rotor-side acceptance opening are arranged in a spatial relationship so that both openings are in temporary fluid communication at least once during a full rotor rotation of the pump rotor. An intermittent lubricant flow or an intermittent lubricant transfer is thus realized. As an alternative, the transfer opening may also be designed as a circular annular channel at the pump rotor so that a constant fluidic connection exists between the supply channel and the transport channel.

The lubricant outlet opening is arranged eccentrically in an end wall of the pump rotor, namely, in the end wall facing the pump-side plug-coupling element. An eccentrically arranged outlet opening is to be understood as an outlet opening that is not arranged in the axial center of the pump rotor so that the lubricant transport to the distal side of the pump-side plug-coupling element does not substantially occur in the axial center. The lubricant flowing out through the outlet opening is transported outward by centrifugal forces so that the lubricant flows to the distal side of the pump-side plug-coupling element via an annular gap between the plug-coupling element and the pump rotor. The lubrication of the entire coupling arrangement, including the motor-side plug-coupling element, is thereby realized in a structurally simple manner.

No fluid channel is provided radially between the outlet opening and the pump rotor center, neither in the pump rotor end wall, nor in the opposite end wall of the plug-coupling element.

The eccentricity of the outlet opening can, for example, be greater than half the radius of the plug-coupling end wall or the plug-coupling element. The further the outlet opening is arranged radially outward, the lower the pressure losses that result, in particular at high rotational speeds, due to the centrifugal force acting radially outward against the lubricant flowing radially inward. A sufficient lubricant supply of the entire coupling arrangement is thereby provided, in particular at high rotational speeds.

The pump rotor end wall in which the lubricant outlet opening is arranged and the opposite plug-coupling end wall can, for example, be situated in a common transversal plane. Both end walls have no channels or grooves with a radially inward directed component.

In an embodiment of the present invention, the housing-side transfer opening and the rotor-side acceptance opening can, for example, be situated in a common cylinder surface.

In an embodiment of the present invention, the pump-side plug-coupling element can, for example, be retained on the pump rotor by a centric retaining bolt, the retaining bolt being fixed in a blind bore of the pump rotor. The blind bore has no immediate fluid connection with the transport channel, i.e., no lubricant flows therethrough. The retaining bolt can, for example, have no open or closed channels having an axial component. The retaining bolt exclusively serves to mechanically retain the pump-side plug-coupling element on the pump rotor, the plug-coupling element being movable with a certain play in both the radial and the axial direction with respect to the pump rotor.

The following is a detailed description of an embodiment of the present invention under reference to the drawings.

FIG. 1 schematically illustrates a vacuum pump arrangement substantially formed by a mechanical vacuum pump 10 for a motor vehicle, an internal combustion engine 52 and a lubricant pump 54 assigned to the internal combustion engine 52. The vacuum pump 10 is mechanically coupled rotatorily with a crankshaft or a drive shaft of the internal combustion engine 52 via a plug-coupling arrangement 68. The vacuum pump 10 serves, for example, to provide an actuating vacuum for various auxiliary aggregates of the motor vehicle, for example, for a pneumatic brake servo. The lubricant pump 54 conveys the liquid lubricant for the lubricant supply of the internal combustion engine 52 and the lubricant supply of the vacuum pump 10.

The vacuum pump 10 is a so-called vane pump and has a pump housing 14 formed substantially by a solid housing body 13 and a housing cover 19. A pump rotor 16 is arranged in the pump housing 14, the rotor being supported for rotation about a longitudinal axis. The pump rotor sliding bearing is formed by a housing-side hollow cylindrical surface 71 and a corresponding rotor-side outer cylinder surface 72. The pump rotor 16 has a rotor body 17 with a radial vane slot 21 in which a rotor vane 18 is supported for radial displacement. The rotor vane 18 rotates in a pump chamber 12 defined by the pump housing 14 and thus conveys air from a non-illustrated pump inlet to a non-illustrated pump outlet.

The plug-coupling arrangement 68 is formed by two plug-coupling elements 20, 50 engaging each other in a manner secured against rotation relative to each other, yet allowing an axial and a radial relative movement of the two plug-coupling elements 20, 50. The pump-side plug-coupling element 20 is itself held for conjoint rotation by the pump rotor 16 via a complex form-fitting structure 60. The form-fitting structure 60 also allows for a radial and axial mobility of the pump-side plug-coupling element 20 relative to the pump rotor 16.

The pump-side plug-coupling element 20 has a continuous central bore 74 through which a retaining bolt 70 is inserted that is securely fixed by an interference fit in a central blind bore 42 of the pump rotor 16. The central bore 74 has an inner diameter that is slightly larger than the outer diameter of the retaining bolt 70 so that a certain radial mobility of the pump-side plug-coupling element 20 is allowed relative to the pump rotor 16. The length of the plug bolt shaft portion extending axially from the central blind bore 42 is slightly larger than the length of the central bore 74 so that a certain axial mobility of the pump-side plug-coupling element 20 is also allowed with respect to the pump rotor 16.

Figure 3:
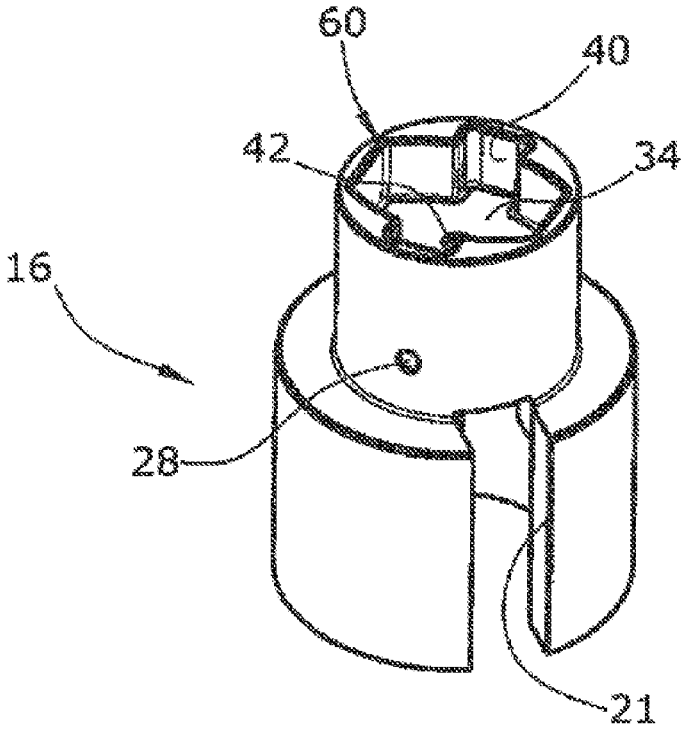
FIG. 3 shows a perspective view of the pump rotor of the vacuum pump for a motor vehicle in FIG. 1.
Figure 4:
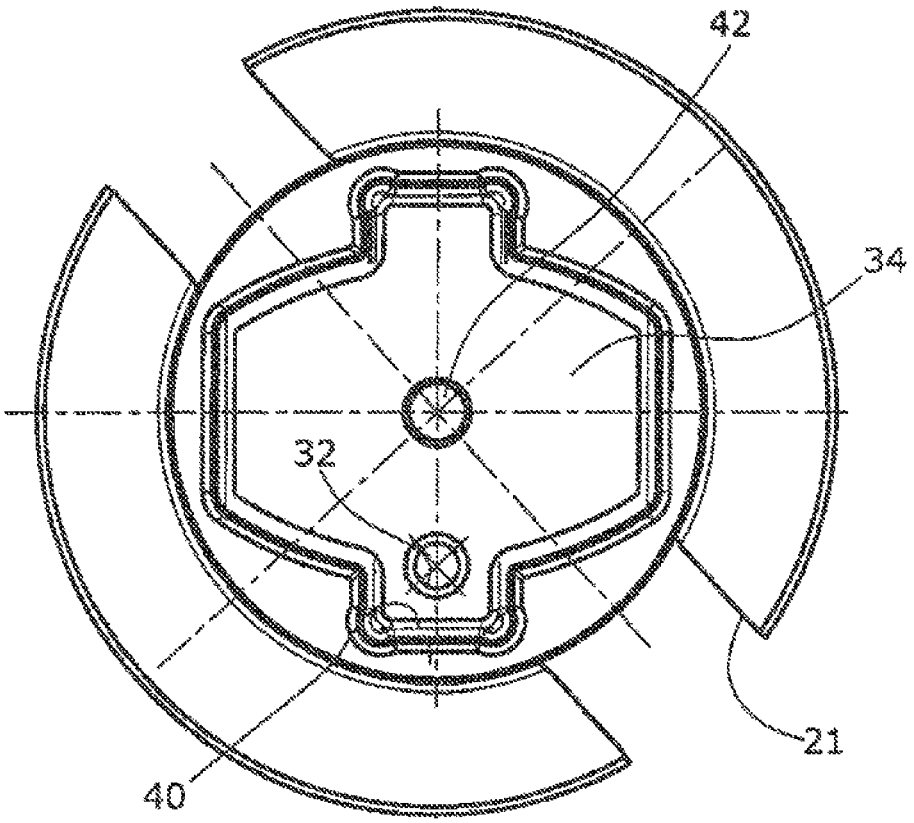
FIG. 4 shows a top plan view on the side of the pump rotor facing the plug-coupling element.

The pump rotor 16 has a form-fitting structure 60 similar to a hollow cross which is only schematically illustrated in FIG. 1 and can be seen in more detail in FIGS. 3 and 4. The form-fitting structure 60 has a bottom wall 34 lying in a transversal plane and is surrounded by a side wall 40 defining the hollow-cross like form-fitting structure 60. On the side facing the pump rotor 16, the pump-side plug-coupling element 20 has a cross-like form-fitting structure that is approximately complementary with the hollow-cross like form fitting structure and establishes a coupling of the pump-side plug-coupling element 20 with the pump rotor 16 that allows conjoint rotation. The pump-side plug-coupling element 20 has a plug-coupling end wall 36 also situated in a transversal plane and parallelly adjoining the bottom wall 34 on the pump rotor-side. A radial gap is provided between the side wall 40 of the form-fitting structure and the circumferential wall 38 of the pump-side plug-coupling element 20, which radial gap allows a certain radial mobility of the pump-side plug-coupling element 20 relative to the pump rotor 16. The pump-side plug-coupling element 20 has a plurality of axial claws 44 on its distal side which interengage with corresponding claws of the motor-side plug-coupling element 50.

The pump housing 14 or the housing body 13 has a lubricant supply channel 22 through which the pressurized liquid lubricant, arriving from a housing-side lubricant inlet 24 via a line 56 from the lubricant pump 54, is directed to a transfer opening 26 situated in the hollow cylinder surface 71 of the rotor sliding bearing. The pump rotor 16 has a lubricant transport channel 30 through which the lubricant is passed from an acceptance opening 28 to a lubricant outlet opening 32. The acceptance opening 28 is situated in the rotor-side outer cylinder surface 72 of the sliding bearing and is arranged so that the acceptance opening 28 is aligned with the transfer opening 26 once per complete rotation of the pump rotor 16, so that an intermittent lubricant flow is thereby provided. The lubricant outlet opening 32 is situated in the bottom wall 34 of the form-fitting structure 60, wherein the plug-coupling end wall 36 of the pump-side plug-coupling element 20 covers the lubricant outlet opening 32, but is still kept at a small axial distance by the fluid pressure of the lubricant flowing out.

Figure 2:
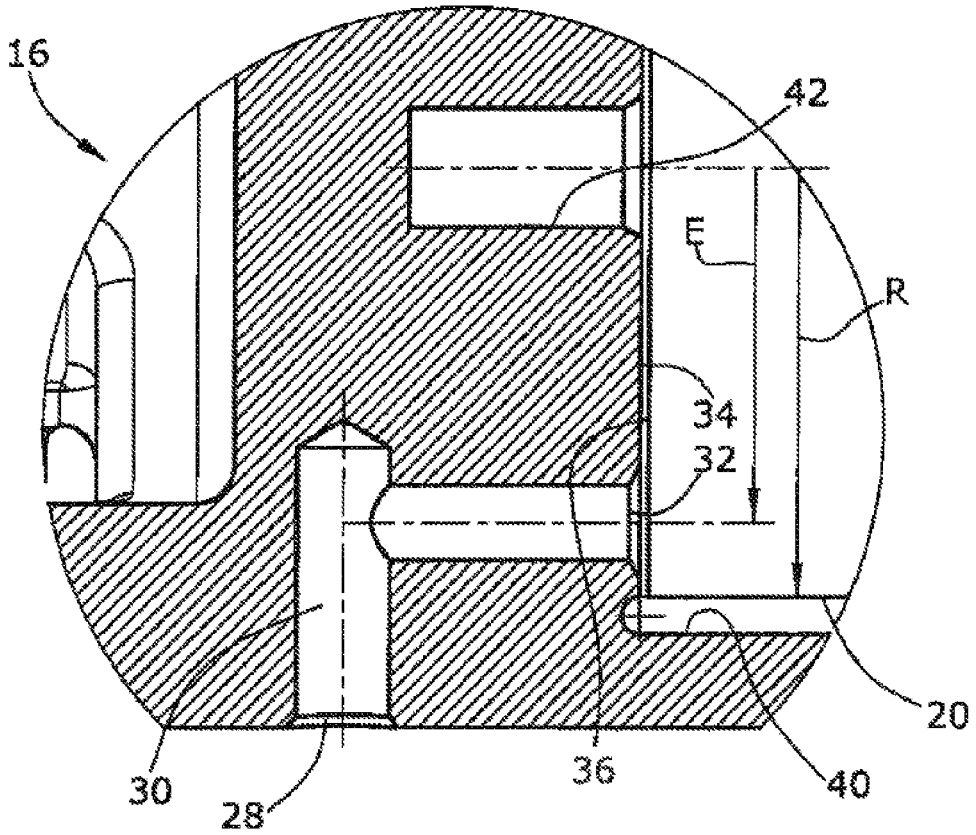
FIG. 2 shows an enlarged illustration of a lubricant supply channel in the housing of the vacuum pump for a motor vehicle in FIG. 1.
Figure 5:
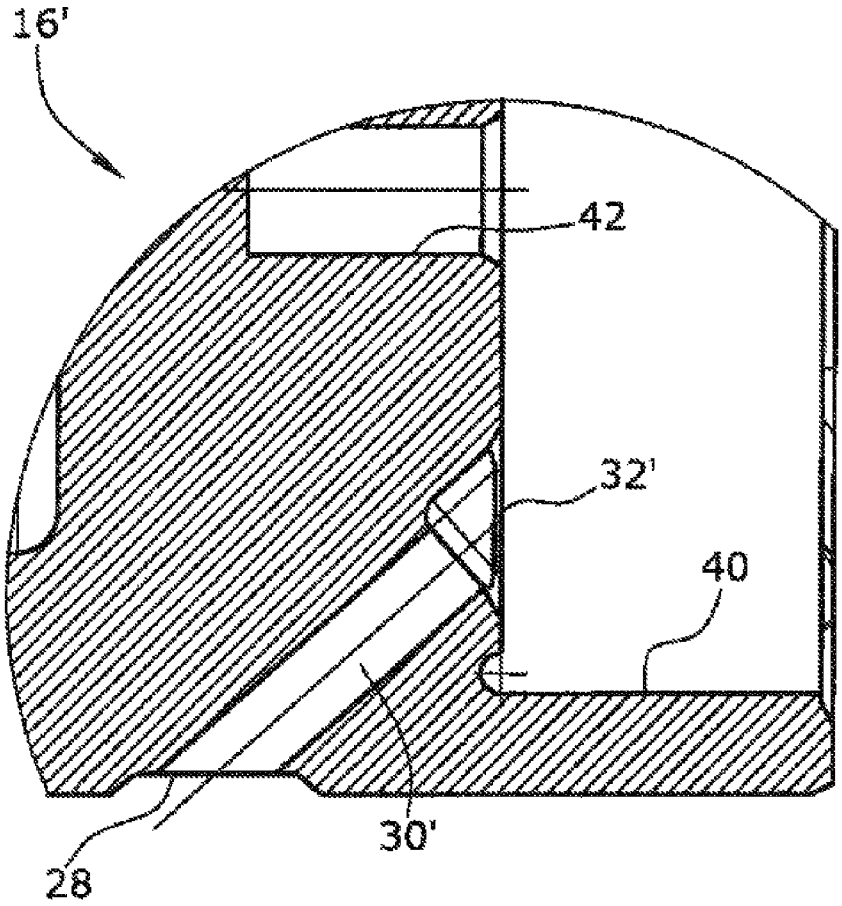
FIG. 5 shows a second embodiment of a stationary lubricant supply channel.

As can be seen well in FIG. 2, the lubricant outlet opening 32 is arranged eccentrically with respect to the rotary axis of the pump rotor 16. In the present case, the eccentricity E of the lubricant outlet opening 32 is greater than ¾ of the radius R of the plug-coupling end wall 36. The transport channel 30 is formed rectangularly in the housing body 13. In a second embodiment of the pump rotor 16' illustrated in FIG. 5, the transport channel 30' opening into the lubricant outlet opening 32' is designed to be inclined and linear. The manufacture of the transport channel 30 is facilitated in this embodiment since its manufacturing only requires a single drilling operation.

The present invention is not limited to embodiments described herein; reference should be had to the appended claims.

What is claimed is:

1. A mechanical vacuum pump for a motor vehicle, the mechanical vacuum pump comprising:

a pump housing configured to be stationary;

a pump rotor comprising an end wall, the pump rotor being rotatably mounted in the pump housing;

a separate pump-side plug-coupling element which is connected for a conjoint rotation with the pump rotor; and a lubricant supply for lubricating the separate pump-side plug-coupling element, the lubricant supply comprising:

a lubricant supply channel arranged in the pump housing, the lubricant supply channel comprising a lubricant inlet and a transfer opening, the lubricant supply channel being arranged so that a lubricant can be pumped from the lubricant inlet in a direction of the separate pump-side plug-coupling element to the transfer opening, and a lubricant transport channel arranged in the pump rotor, the lubricant transport channel comprising an acceptance opening and a lubricant outlet opening, the lubricant transport channel being arranged so that the lubricant can be pumped from the acceptance opening to the lubricant outlet opening, wherein, the transfer opening and the acceptance opening are arranged so that they are temporarily in a fluid communication with each other at least once during a rotation of the pump rotor, and the lubricant outlet opening is arranged with an eccentricity in the end wall of the pump rotor.

2. The mechanical vacuum pump as recited in claim 1, wherein, the separate pump-side plug-coupling element comprises a plug-coupling end wall which comprises a radius, and the eccentricity of the lubricant outlet opening is greater than half the radius of the plug-coupling end wall.

3. The mechanical vacuum pump as recited in claim 2, wherein the end wall of the pump rotor and the separate pump-side plug-coupling end wall are arranged in a common transversal plane.

4. The mechanical vacuum pump as recited in claim 1, wherein the transfer opening and the acceptance opening are arranged in a common cylinder surface.

5. The mechanical vacuum pump as recited in claim 1, further comprising:

a retaining bolt, wherein, the pump rotor further comprises a blind bore, the retaining bolt is fixed in the blind bore of the pump rotor, and the separate pump-side plug-coupling element is retained at the pump rotor by the retaining bolt.

* * * * *